United States Patent [19]

Baker et al.

[11] 4,362,174

[45] Dec. 7, 1982

[54] TOOTHBRUSHES

[75] Inventors: Hugh W. B. Baker, Beaconsfield; Charles C. Packham, Wokingham; Norman C. Welsh, Bradfield, all of England

[73] Assignee: The Gillette Company, Boston, Mass.

[21] Appl. No.: 227,452

[22] Filed: Jan. 22, 1981

[30] Foreign Application Priority Data

Jan. 24, 1980 [GB] United Kingdom ..... 8002410
Dec. 18, 1980 [GB] United Kingdom ..... 8040554

[51] Int. Cl.[3] ..... A45D 44/18
[52] U.S. Cl. ..... 132/84 R
[58] Field of Search ..... 132/84 R, 11 A, 85

[56] References Cited

U.S. PATENT DOCUMENTS

| | | | |
|---|---|---|---|
| 730,040 | 6/1903 | McKinley et al. | 132/84 B |
| 1,007,864 | 11/1911 | Goldy | 132/84 B |
| 2,486,062 | 10/1949 | Ridner, Sr. | 132/84 R |
| 2,668,973 | 2/1954 | Glaza et al. | 132/84 R |
| 2,893,031 | 7/1959 | Dengler | 132/84 R |

FOREIGN PATENT DOCUMENTS

| | | |
|---|---|---|
| 216355 | 5/1924 | United Kingdom . |
| 294895 | 12/1928 | United Kingdom . |
| 326074 | 3/1930 | United Kingdom . |
| 995428 | 6/1965 | United Kingdom . |
| 1210223 | 10/1970 | United Kingdom . |
| 1317752 | 5/1973 | United Kingdom . |
| 1389843 | 4/1975 | United Kingdom . |
| 1498788 | 1/1978 | United Kingdom . |

*Primary Examiner*—G. E. McNeill
*Attorney, Agent, or Firm*—Scott R. Foster

[57] ABSTRACT

A toothbrush system comprises a dispensing container for a number of exchangeable toothbrush heads engageable in turn with a common handle which can be firmly engaged with an individual head while the head is held in the container. The container is further provided with a special chamber adapted for receiving the head and disengaging the head from the handle.

17 Claims, 16 Drawing Figures

TOOTHBRUSHES

BACKGROUND OF THE INVENTION

1. Field of the Invention

This invention relates to toothbrushes and is directed more particularly to a toothbrush system including a dispensing container for a number of toothbrush heads engageable with a common handle.

2. Description of the Prior Art

Many people use a conventional toothbrush for such a long time that the brush becomes heavily bacteria-laden due to the build up of debris between the bristles of the brush and also becomes inefficient with prolonged use.

A great many proposals have been made in the past to provide toothbrushes with exchangeable heads but many have been unsatisfactory in their efforts to provide a convenient but secure coupling and have involved the necessity for the user to grip the head directly in the acts of engaging it with, and of disengaging it from the handle. These problems are dealt with in a relatively simple but effective manner in the embodiments described below.

SUMMARY OF THE INVENTION

In an effort to encourage users to achieve a higher standard of dental hygiene, the present invention provides a system comprising a toothbrush handle and a plurality of brush heads held in a container, the handle being securely engageable with each brush head to remove it from the container and disengageable therefrom to allow the used head to be discarded and a fresh one to be engaged.

In the embodiments described herein, the brush head comprises a generally planar back plate whose lower surface carries the usual set of bristles and the parts are constructed to be engaged and disengaged by relative sliding movement in planes parallel to the plane of the back plate.

In one embodiment, the parts slide longitudinally of the handle and are secured in the engaged position by snap-acting latch means which prevent inadvertent release of the parts.

In an alternative embodiment, the parts are subjected to relative rotation about an axis perpendicular to the plane of the back plate, the handle having opposed end walls which are concave and opposed and co-operate with convexly arcuate end edges on the brush back plate. The complementarily curved surfaces have co-operating guide rails and recesses which lock the parts against relative movement along the axis of rotation which also constitutes the centre of curvature of the said walls and end edges.

The container preferably makes provision for the easy release of a used head from the handle without necessity for the user to grip the dirty head.

BRIEF DESCRIPTION OF THE DRAWINGS

Two toothbrush systems in accordance with the invention will now be described, by way of example, with reference to the accompanying drawings, in which.

DESCRIPTION OF THE PREFERRED EMBODIMENTS

Figure 1:
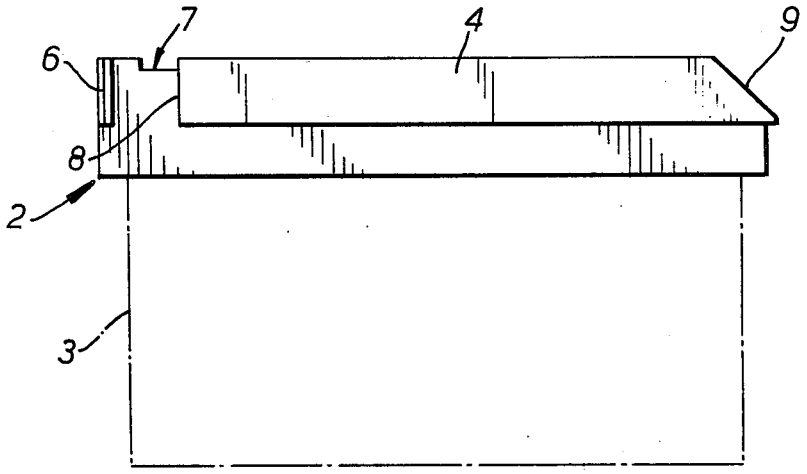
FIGS. 1,2 and 3 are side, top and end views respectively of a toothbrush head back plate.
Figure 2:
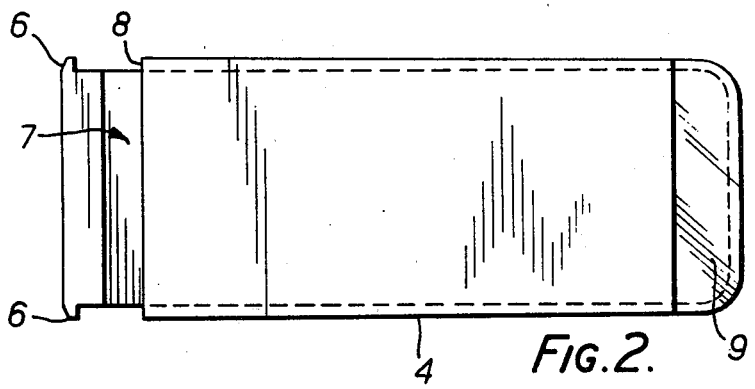
Figure 3:
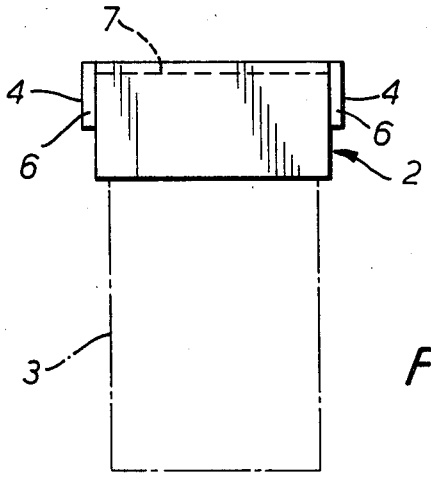

FIGS. 1 to 3 show the main constructional details of a toothbrush head which comprises a moulded back plate 2 having a set of bristles 3 set into it. The longitudinal side edges of the plate are undercut to provide laterally projecting side rails 4. The front or nose portion of the plate is formed with a pair of laterally projecting lugs 6 and a transverse slot 7 is formed in the upper surface of the plate. In the same forward region, the rails 4 terminate at forwardly facing shoulders 8. At its rear end, the plate has a chamfered lead-in surface 9.

Figure 4:
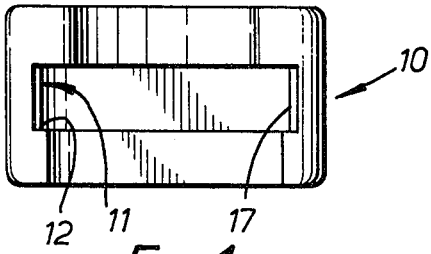
FIGS. 4,5 and 6 are an end view, bottom plan and sectional view, respectively, of a toothbrush handle for co-operation with the head of FIGS. 1 to 3.
Figure 5:
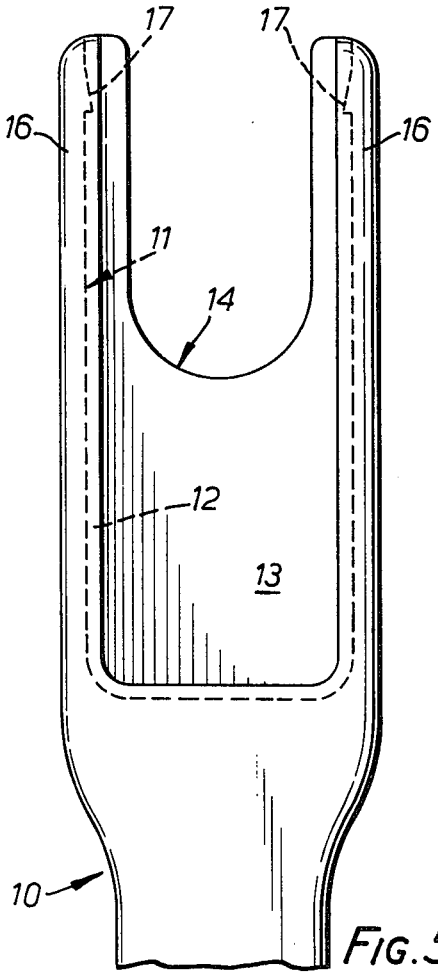
Figure 6:
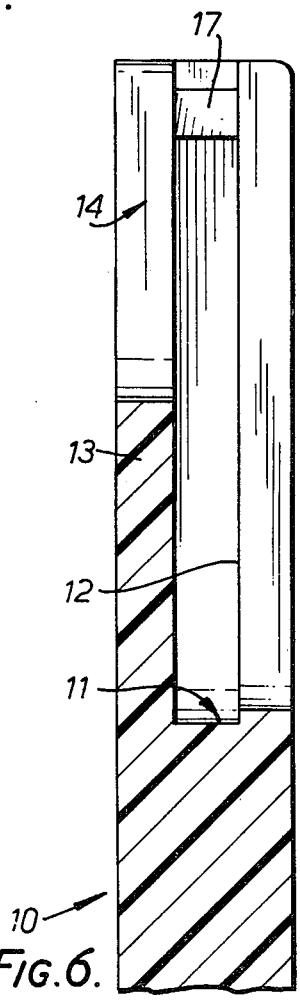

Details of the co-operating handle 10 are illustrated in FIGS. 4 and 6. The handle 10 is of moulded construction and is formed with a main recess 11, to receive the brush back plate, bounded from below a narrow ledge 12 extending around three sides of the recess and from above by a top wall portion 13 the forward part of which is bifurcated at 14 to leave a pair of forwardly projecting arms 16. Towards the free ends of the arms are formed respective catches 17 projecting inwardly over the depth of the recess 11.

The depth of the recess 11 is dimensioned to make an easy sliding fit over the guide rails 4 of a brush head, and the catches 17 are dimensioned and positioned to make snap fitting interengagement with the shoulders 8 of the head.

Figure 7:
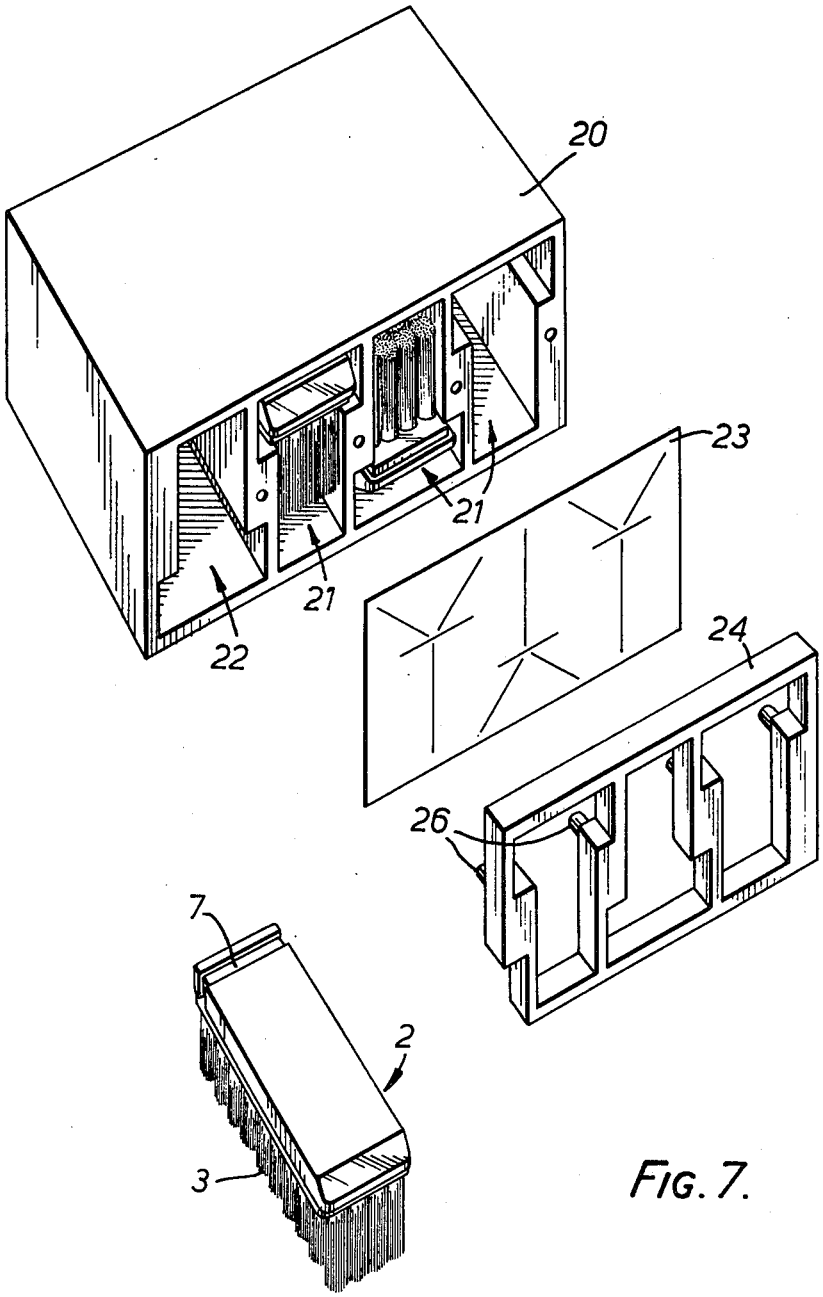
FIG. 7 is an exploded perspective view of a container and toothbrush heads in accordance with the invention.

The components of the container for use with the above described head and handle are illustrated in FIG. 7, which additionally shows a complete brush head in perspective.

The container comprises a moulded body 20 formed with three chambers 21 for housing unused brush heads and a fourth chamber 22 for unloading brush heads. The four chambers 21,22 are of T-shaped cross-section which are alternately inverted in the interests of compactness, and all except chamber 22 are closed at their rear ends. The container is completed by a metallic foil 23 and coverplate 24 having T-shaped holes through it to register with the three chambers 21 of the body 20.

In production, three heads are located in chambers 21 and the foil is heat sealed onto the flat forward face of the body. The cover plate 24 is then secured to the body e.g. by means of dowels 26. Each head is thus retained in its chamber by the foil, and also completely sealed against contamination.

It will be noted that the foil is creased according to the pattern of a letter Y with a short transverse crease at the junction of the Y. These creases form lines of weakness producing a predetermined sequence of rupturing of the foil when a brush head is to be withdrawn, as will be described in more detail below.

Figure 8:
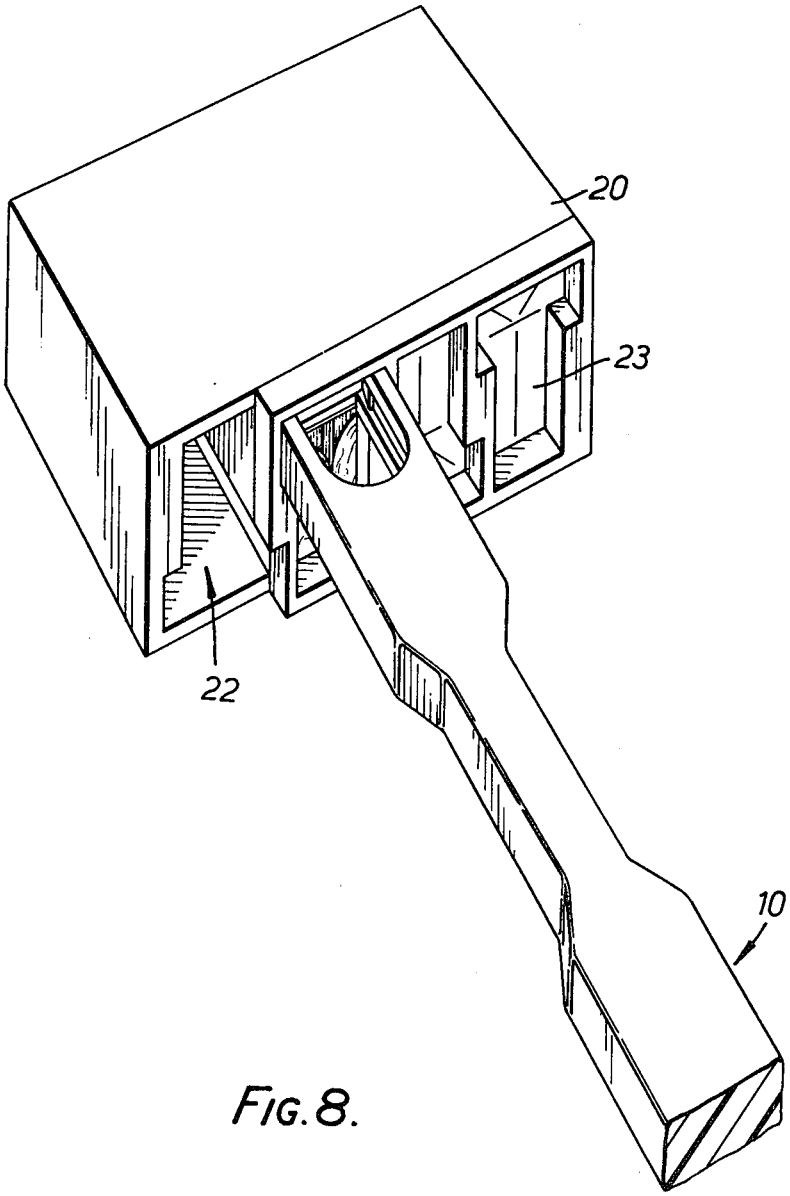
FIGS. 8 and 9 are perspective views illustrating different stages in the operation of engaging a head on the handle and withdrawing it from the container.

In use of the system, the handle is pushed into the appropriate cover plate slot causing the foil to rupture along the upper set of crease lines to turn back the resulting triangular flaps into the container chamber 21 (See FIG. 8). As the handle enters the chamber, the guide rails 4 of the head are engaged in the handle recess 11. The catches 17 engage the sides of the guide rails causing the arms 16 to be slightly sprung apart, until the catches pass the shoulders 8, whereupon the arms snap back to engage the catches with the shoulders.

Figure 9:
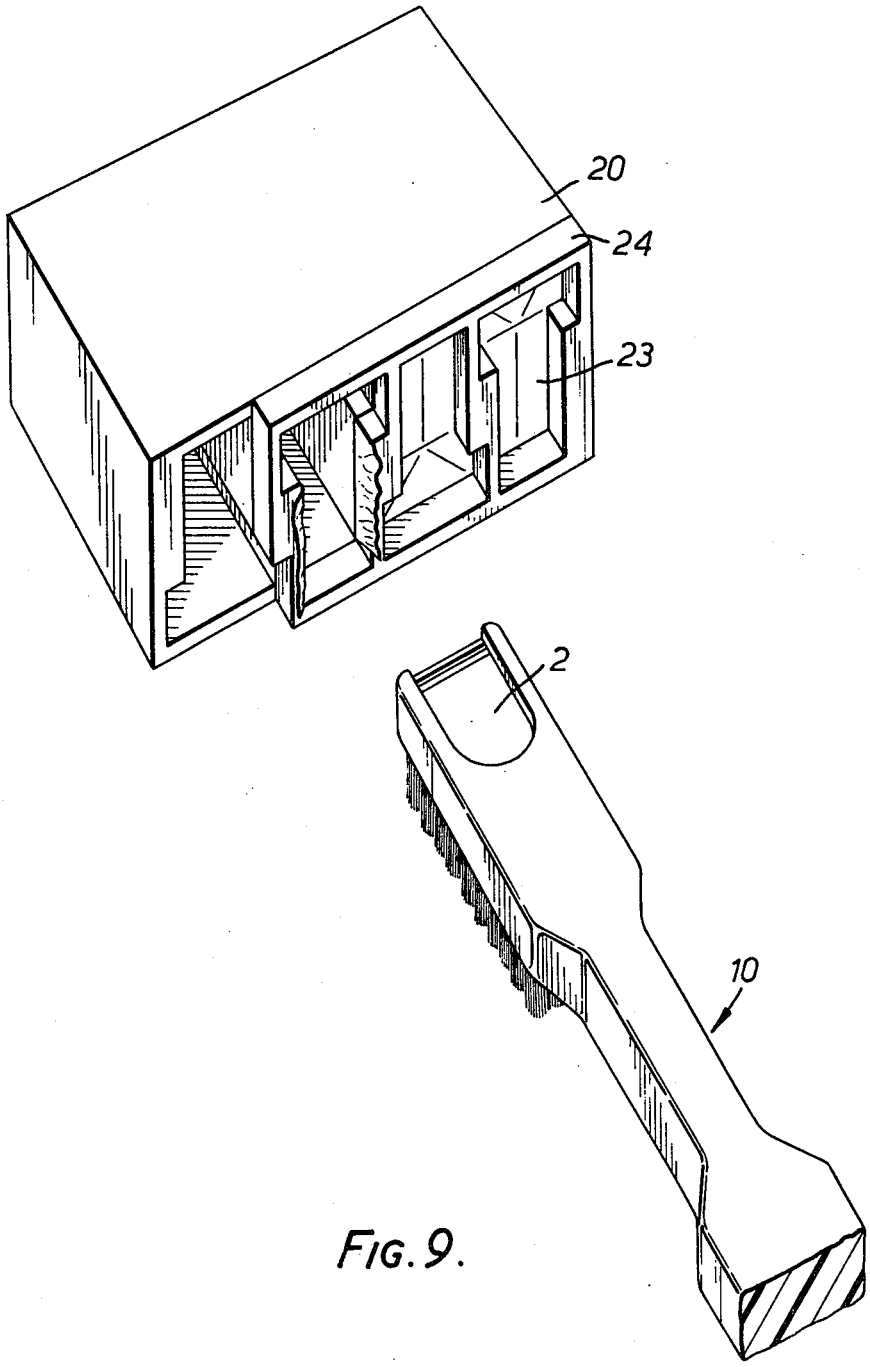
Figure 10:
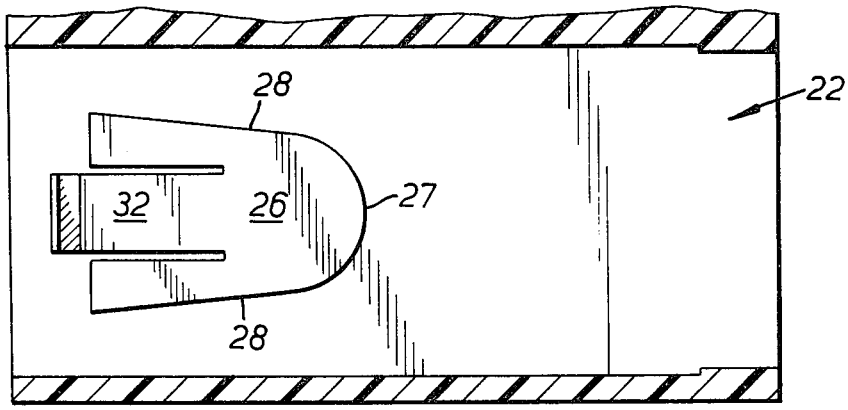
FIGS. 10 and 11 are sectional views, on an enlarged scale, showing details of an unloading compartment of the container.
Figure 11:
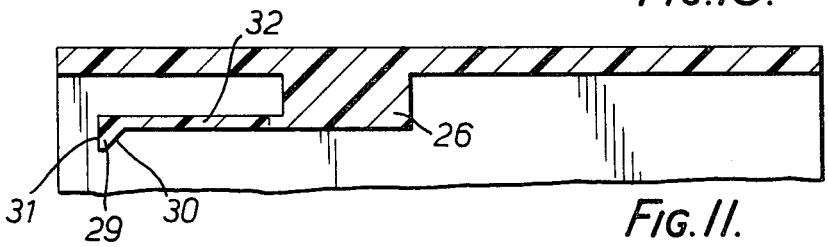

The handle is thereby firmly and positively engaged with the head and can be withdrawn from the chamber, breaking out the remaining two flaps of the foil (See FIG. 9). In the fully engaged position, the lugs 6 of the head serve to close off the ends of the recess 11 against the ingress of toothpaste and debris.

The unloading chamber 22 of the container is provided with means for effecting release of the head from the handle, these means being provided on the inner surface of that wall of the container which overlies the wider end of the T-section of the chamber. The means comprise a depending cam 26, having a rounded nose portion 27 and divergent sides 28. Integral with the cam 26 is a resilient latch finger 32 carrying at its free end a latch projection 29 having an angled face 30 and a latching face 31 perpendicular to the length of the finger and of the chamber.

Figure 12:
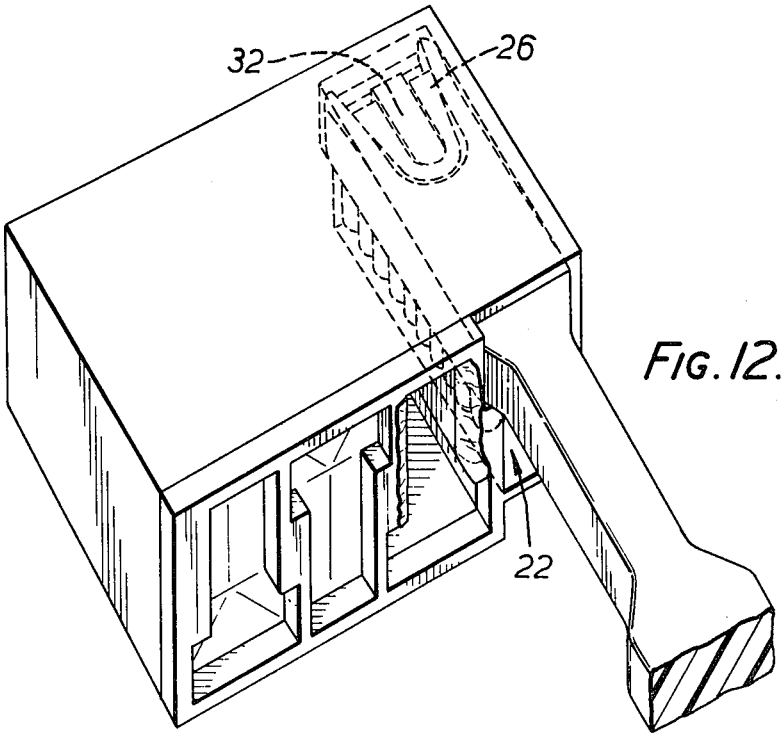
FIGS. 12 and 13 are perspective views showing successive stages in the unloading of a used toothbrush head.

When a used brush head is to be discarded, the container is positioned approximately in the orientation indicated in FIG. 12 and the brush head and handle are pushed into the front end of the unloading chamber. Towards the end of this movement, the free ends of arms 16 engage the diverging sides 28 of the cam 26 and are thereby sprung apart to disengage the catches 17 from shoulders 8. In the final stage of movement the nose portion of the brush head back plate engages the angled face 30 of finger 32, deflecting the finger upwardly until the slot 7 comes into registry with the projection 29, which then snaps into the recess, to engage the latching face in front of the adjacent edge of the slot (see FIG. 12).

Figure 13:
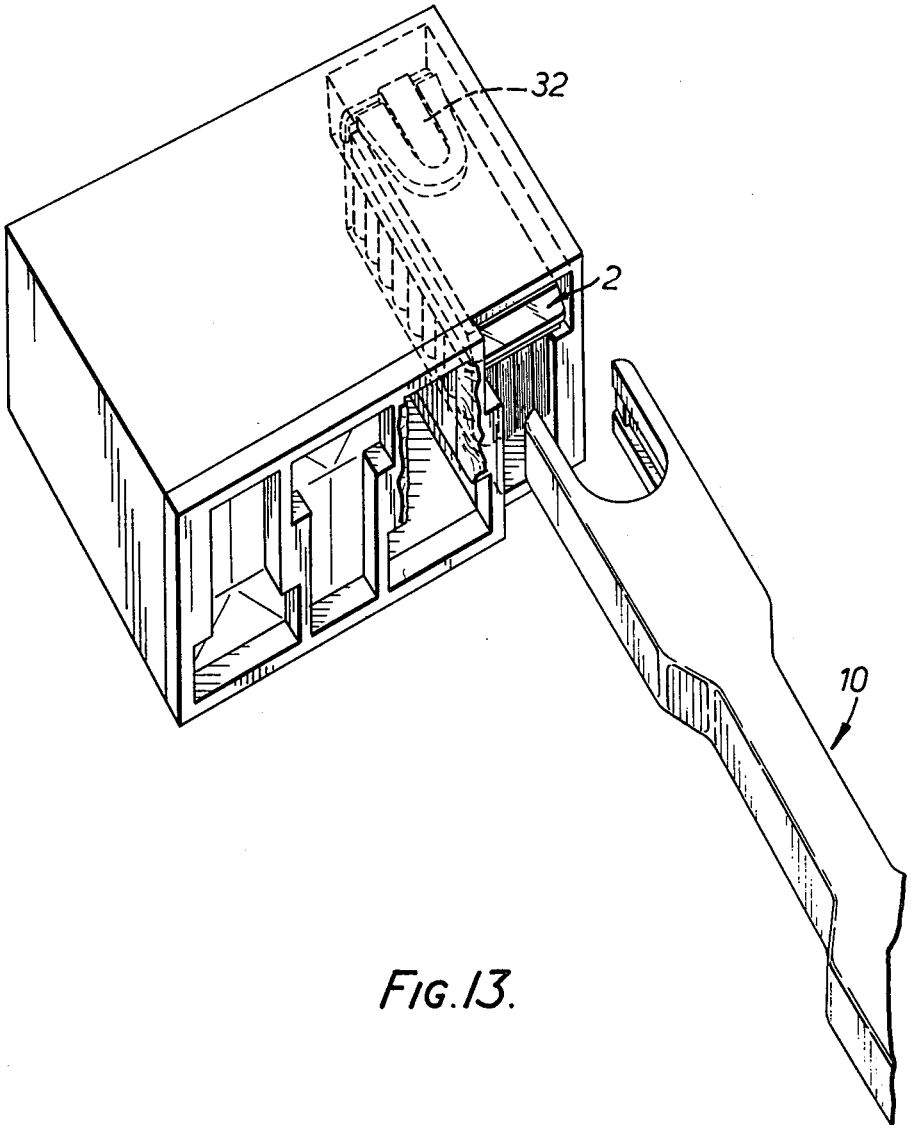

The handle is then pulled rearwardly while the head is retained by the latching projection 29. When the handle catches 17 clear the cam 26, the arms 16 return to their normal position and the catches ride easily along the smooth outer surfaces of the guide rails. As soon as the handle is clear of the chamber (see FIG. 13) the head is relatively loose in the chamber and is free to drop down onto the ledges of the T-section, clear of the latching finger 32 and to slide out of either end of the chamber.

Whilst these actions have been described in detail, and are of course carefully inter-related, the operation is extremely simple for the user, who simply enters the head into the chamber until he hears and feels a click as the latching finger snaps home, and immediately withdraws the handle.

Whereas the storage chambers 21 need to be closed at their rear ends, and this presents no complications since the chamber is of uniform cross-section throughout, the unloading chamber is left open at both ends to ease moulding of the container body and discharge of a used head, and also to facilitate rinsing of the chamber in the event of it becoming fouled with paste and debris.

Figure 14:
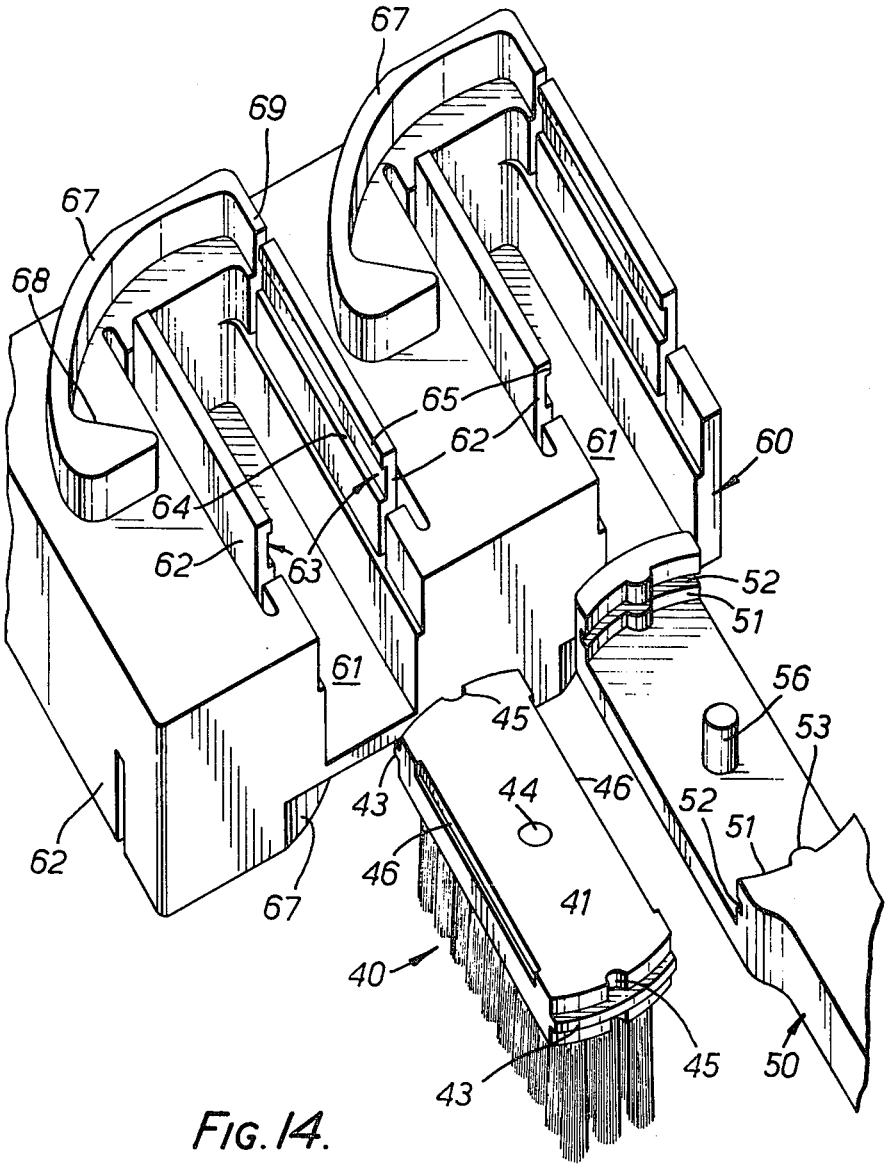
FIG. 14 is a perspective view of part of a handle, a brush head and a container of the second system.
Figure 15:
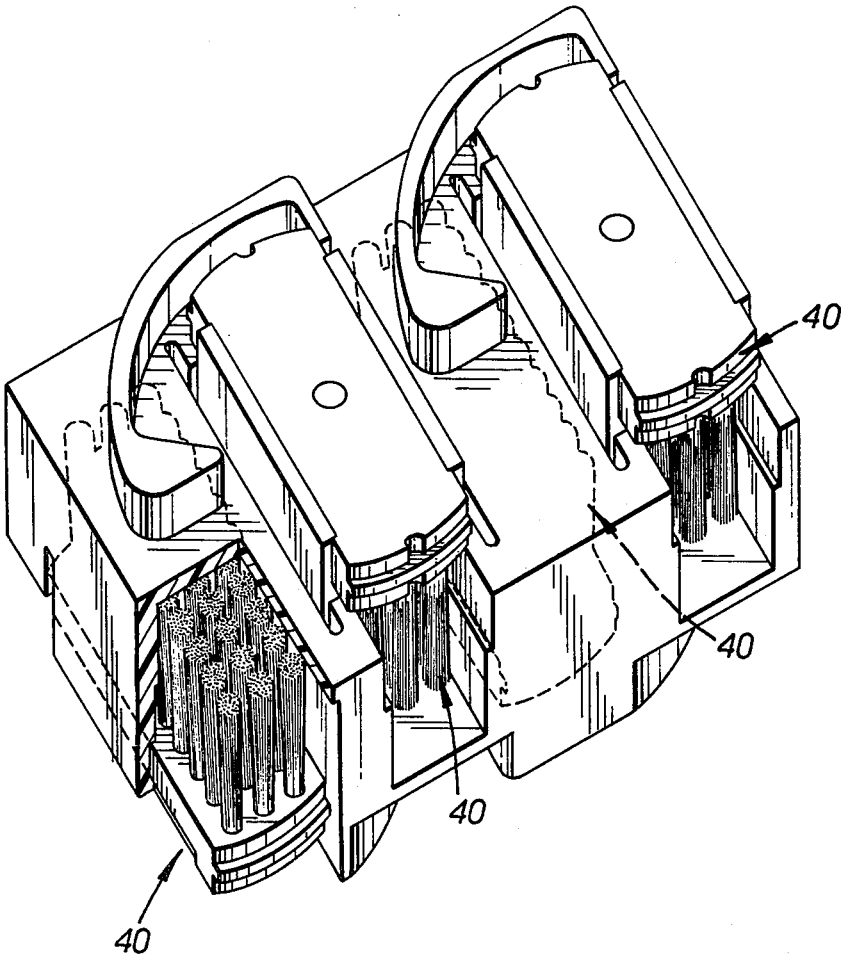
FIG. 15 is a perspective view, partly broken away, of the container of FIG. 14 with four brush heads in place.
Figure 16:
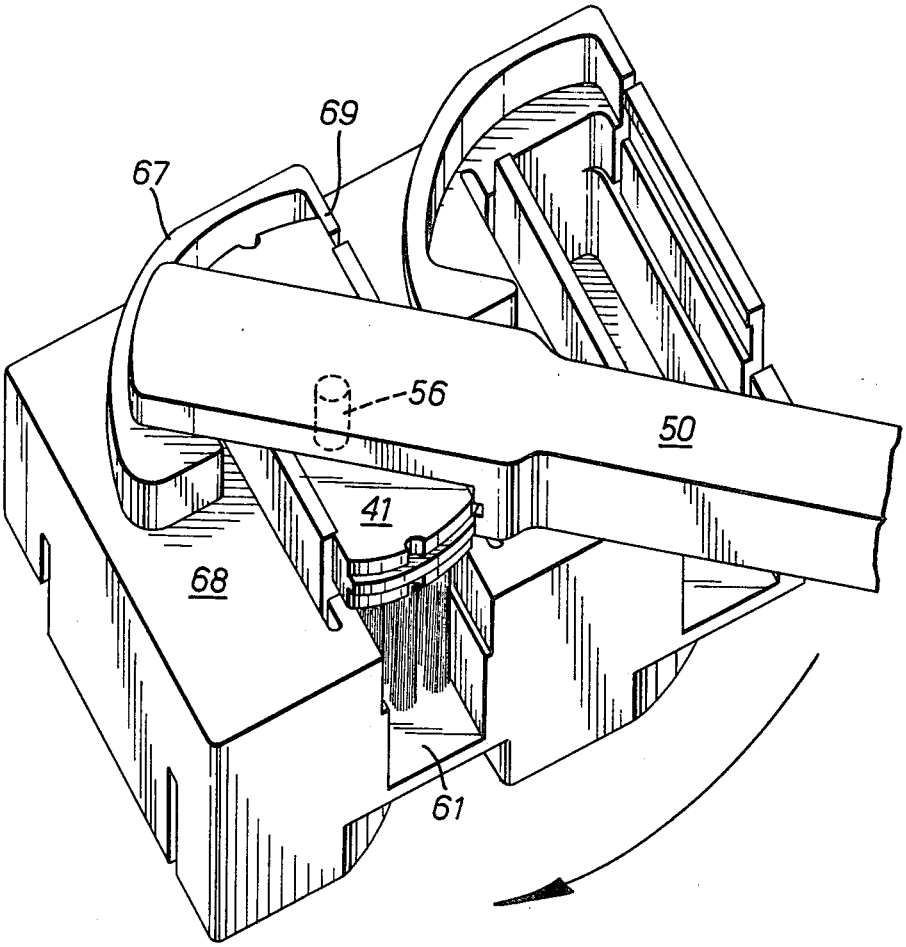
FIG. 16 is a perspective view showing a preliminary stage in the engagement of a brush head by the handle.

In the system illustrated in FIGS. 14 to 16, the handle, brush head and container are designed to provide for coupling and uncoupling of the head and handle by angular motion about an axis perpendicular to the handle and brush back plate.

Each brush head 40 has a back plate 41 having convex arcuate end edges and guide rails 43 concentric with the axis of a central hole 44 perpendicular to the general plane of the back plate. The central regions of the end edges are each formed with a detent notch 45, and the side edges of the back plate are formed with longitudinal recesses 46, whose function is described below.

The co-operating handle 50 has a recess open from below and at both sides, and bounded at its ends by concave arcuate walls 51 with transverse recesses 52 and detent pips 53, for complementary co-operation with the corresponding end edges, guide rails 43 and detent notches 45 of the heads. A pin 56 is formed in the base of the recess on the axis of curvature of the end walls 51.

As best seen in FIGS. 14 and 15 the container 60 which may be manufactured as a unitary injection moulding, is designed to house a number of brush heads, in this case four, in individual compartments arranged substantially side by side but alternately open from opposite side and ends of the container. For convenience and clarity of description the container is assumed to occupy a horizontal position in the drawings, so that two compartments 61 are open from above.

Each compartment 61 is closed at one end, and open at its opposite (forward) end. Over the major part of its length each side wall of the compartment is formed by an upstanding resiliently flexible wall portion 62 having longitudinal recesses 63 bounded from below by a ledge 64, which engages and supports the underside of the brush back plate and from above by a rail 65, which engages in the adjacent recess 46 of the back plate, so that the ends of the brush head back plate project at both ends of the wall portions 62. An upstanding guide wall 67 is formed beyond the rear or inner end of each compartment and extends to one side of it, terminating at radial stops 68,69.

To engage the handle with a selected brush head, it is positioned over the head as shown in FIG. 16, with the pin 56 engaged in the hole 44 and with the handle set at an angle to the brush head so that one edge of the adjacent end wall 51 is close to the radial stop 68. Rotation of the handle in the direction indicated by an arrow in FIG. 16 causes the rails 43 to engage in the recesses 52 and rotation is checked by the handle encountering the radial stop 69 at the position in which the detent pips 53 snap into the detent notches 45 of the brush back plate.

The head is now securely engaged with the handle and can be pulled out of the compartment in the longitudinal direction, with concomitant resilient deflection of the side wall portion 62 as the rails 65 are forced out of the recesses 46.

Removal of the brush head is effected by reversal of the above described procedure, depositing the used head firmly back in a compartment.

In this embodiment the components particularly the container are of rather complicated form, but the engagement between the brush head and handle is particularly strong since the head is mechanically locked in position by the end walls of the handle against longitudinal and lateral displacement.

In a variant of the container shown in FIGS. 7 to 13, the chambers are all given the same orientation, with the wider parts of the chambers parallel with the smallest dimension of the container body, which is accordingly slimmer but longer than illustrated.

Having thus described our invention, what we claim as new and desire to secure by Letters Patent of the United States is:

1. A toothbrush system comprising
a handle,
a plurality of exchangeable toothbrush heads, and
a container for said heads,
said container having a plurality of compartments, each of said compartments being adapted to releasably retain one of said heads, each of said compartments having an opening therein,
said handle being insertable through said opening to engage said head in said compartment and being withdrawable from said compartment with said head secured to said handle.

2. A system according to claim 1, wherein each said head comprises a generally planar back plate in which a set of bristles is secured, said back plate having a pair of opposed edges which are profiled to complement corresponding opposed edges formed on said handle, engagement and disengagement being effected by relative movement of said handle and said head in planes parallel with that of said back plate.

3. A system according to claim 2, wherein said back plate has longitudinal side edges co-operable with corresponding edges extending longitudinally of said handle to permit relative sliding movement in the longitudinal direction, and wherein resilient detent means are provided to secure the head and handle in their desired relative positions for use.

4. A system according to claim 3, wherein said handle has a bifurcated forward end portion defining a pair of generally parallel arms having confronting inner surfaces which constitute said corresponding edges, said arms being resilient to permit separation of their free ends upon insertion of said back plate therebetween and the arms having catch means which make snap-fitting interengagement with co-operating portions of said back plate, when said back plate is fully inserted between said arms to lock said head between said arms of said handle.

5. A system according to claim 2 wherein said plurality of compartments is arranged side by side, each of said compartments having said opening at one end thereof, each of said heads being located in one of said compartments with the back plate of said head being located by respective side walls of the compartment, and means releasably retaining each head in its compartment.

6. A system according to claim 4 wherein said container comprises a chamber for receiving a used head, said chamber including a stationary cam member positioned to engage the arms of said handle and spring said arms apart as said handle and head are advanced into the chamber to disengage said catch means from said back plate.

7. A system according to claim 6, wherein said chamber further comprises a resilient latch member positioned to engage said back plate and retain it temporarily to permit withdrawal of the handle from said chamber.

8. A system according to claim 2, wherein said handle has an outer end formed with a pair of longitudinally spaced opposed walls arranged to embrace and engage opposite end edges of said back plate of a head against movement relative to said handle in all but a lateral direction, detent means being provided for restraining movement in the lateral direction.

9. A system according to claim 8, wherein inwardly facing surfaces of said walls are concavely arcuate about a common axis and the end edges of said back plate are of complementary convex form, the said end edges and walls having co-operating guide rails and recesses which lock said handle and head, when interengaged, against relative movement parallel to the said common axis.

10. A system according to claim 9, wherein said back plate and handle have co-operating guide pin and hole means arranged on said common axis, the pin engaging in the hole to guide the handle and head for relative rotation about said axis between respective positions of engagement and disengagement between the opposed walls and end edges.

11. A system according to claim 9, wherein said co-operating arcuate surfaces of the opposed walls and end edges have co-operating, snap engaging detent means to restrain the handle and head against rotation about said common axis.

12. A system according to claim 9 wherein said container comprises a plurality of compartments, each housing a head with its bristles directed towards the bottom of the compartment, the compartment being open from above and from one end, with said back plate having its upper surface and end edges exposed for engagement from above by said handle, the compartment having opposed resilient side wall portions engaging the longitudinal edges of said back plate, the arrangement being such that said handle can be engaged with the upper surface of said back plate and then rotated to engage the opposed walls of the handle with the end edges of the back plate, whereafter the head can be withdrawn, by the handle, through the open end of the compartment.

13. A toothbrush system comprising
a handle,
a plurality of exchangeable toothbrush heads, each said head comprising a generally planar back plate in which a set of bristles is secured, said back plate having a pair of opposed edges which are profiled to complement corresponding opposed edges disposed on said handle, and
a container for said heads,
said handle being adapted for secure but releasable engagement with each of said heads,
said container having a plurality of compartments arranged side by side, each of said compartments being adapted to hold one of said heads and adapted to permit engagement with each said head by said handle, said back plate of each said head being located by side walls of its respective compartment, engagement being effected by relative movement of said handle and said head in planes parallel with that of said back plate, each of said compartments having an opening at one end thereof, said handle being insertable through said opening of each compartment to engage said head therein and withdraw said head from said compartment secured to said handle,
whereby to remove said head from said container by means of said handle.

14. A system according to claim 4 or 13, wherein said opening of each said compartment is covered by a rupturable foil.

15. A system according to claim 5 or 13 wherein the container further comprises a chamber in which a used head can be located while still engaged with the handle, and means associated with the chamber for disengaging the handle from the head, allowing the handle to be withdrawn from said head.

16. A toothbrush system comprising a handle said handle having a bifucated forward end portion defining a pair of generally parallel arms having confronting inner surfaces, said arms being resilient to permit separation thereof, a plurality of exchangeable toothbrush heads, each of said heads comprising a generally planar back plate in which a set of bristles is secured, said back plate having a pair of opposed edges which are profiled to complement corresponding opposed edges on said handle, and a container for said heads, said container holding said heads and adapted to permit engagement with said handle, said handle being adapted for secure but releasable engagement with each of said heads in turn, engagement and disengagement being effected by relative movement of said handle and said head in planes parallel with that of said back plate, resilient detent means being provided to secure said head and handle together when said back plate is fully inserted between said arms, said container including a chamber for receiving a used head, said chamber including a stationary cam member positioned to engage between said arms and force said arms apart, whereby to remove said head from said container by means of said handle.

17. A toothbrush system comprising a handle, a pair of longitudinally spaced opposed walls arranged at an outer end of said handle, said walls being concavely accurate, a plurality of exchangeable toothbrush heads, each of said heads comprising a generally planar back plate in which a set of bristles is secured, said back plate having a pair of edges which are profiled to complement said opposed walls on said handle, said opposed walls and said edges having cooperating guide rails and recesses thereon, and a container for said heads said container having a plurality of compartments, each compartment being adapted to retain one of said heads therein, the compartment being open from above and one end, said back plate having an upper surface and said edges exposed for engagement from above by said handle, said handle being adapted for engagement with said upper surface of said back plate and rotated to engage said opposed walls of said handle with said end edges of said back plate, whereby to remove said head from said container by means of said handle through said open end of said compartment.

* * * * *